US007458349B2

(12) United States Patent
Yoshikawa

(10) Patent No.: US 7,458,349 B2
(45) Date of Patent: Dec. 2, 2008

(54) VALVE TRAIN APPARATUS FOR 4 STROKE-CYCLE INTERNAL COMBUSTION ENGINE

(76) Inventor: Masaaki Yoshikawa, 40-405, 3-chome, Kamoe, Shizuoka-Ken, Naka-Ku, Hamamatsu-Shi (JP) 432-8023

( * ) Notice: Subject to any disclaimer, the term of this patent is extended or adjusted under 35 U.S.C. 154(b) by 0 days.

(21) Appl. No.: 11/532,370

(22) Filed: Sep. 15, 2006

(65) Prior Publication Data

US 2007/0074690 A1 Apr. 5, 2007

(30) Foreign Application Priority Data

Oct. 4, 2005 (JP) ..... 2005-317386
Jul. 27, 2006 (JP) ..... 2006-204542

(51) Int. Cl.
*F01L 1/34* (2006.01)

(52) U.S. Cl. ..... 123/90.16; 123/90.15; 123/90.31

(58) Field of Classification Search ..... 123/90.16, 123/90.39, 90.15, 90.31
See application file for complete search history.

(56) References Cited

U.S. PATENT DOCUMENTS 6,497,206 B2 * 12/2002 Nohara et al. ..... 123/90.16
6,955,146 B2 * 10/2005 Werler ..... 123/90.16

OTHER PUBLICATIONS

The Germany magazine Motortechnische Zeitschrift, Vieweg Verlag/GWV Fachverlage GmbH, Nov. 2004, pp. 868, 876 and 878.

The Germany public magazine BMW Aftersales, BMW Corporation, Nr. 75, p. 18.

* cited by examiner

*Primary Examiner*—Zelalem Eshete
(74) *Attorney, Agent, or Firm*—Darby & Darby P.C.

(57) ABSTRACT

A valve train apparatus of 4 stroke-cycle internal combustion engine includes an intake cam shaft, an exhaust cam shaft, an eccentric cam shaft, an intermediate lever, a rocker arm, and an intake valve. A lift of the intake valve is continuously varied by controlling rotations of the intake cam shaft and the eccentric cam shaft via the intermediate lever contacting the intake cam shaft and the eccentric cam shaft, and via the rocker arm contacting the intermediate lever. At least two of a parting surface of a bearing of the eccentric cam shaft, a parting surface of a bearing of the intake cam shaft, and a parting surface of a bearing of the exhaust cam shaft are arranged on a coplanar surface.

6 Claims, 6 Drawing Sheets

VALVE TRAIN APPARATUS FOR 4 STROKE-CYCLE INTERNAL COMBUSTION ENGINE

INCORPORATION BY REFERENCE

The present application claims priority under 35 U.S.C. §119 to Japanese Patent Application No. 2005-317386 filed Oct. 4, 2005, and Japanese Patent Application No. 2006-204542 filed Jul. 27, 2006, the entire contents of which being hereby incorporated herein by reference.

BACKGROUND OF THE INVENTION

1. Field of the Invention

The present invention relates to a valve train apparatus for 4 stroke-cycle internal combustion engine.

2. Description of Background Art

Recently the 4 stroke-cycle internal combustion engine has been provided with a valve train apparatus in which output of the engine can be controlled by controlling an amount of intake air with carrying out continuously variable control of an amount of lift of an intake valve and the valve timing in accordance with running condition of a vehicle as well as high performance during a high loading condition and improvement of fuel consumption with reducing a pumping loss during a low loading condition can be simultaneously achieved.

In a conventional valve train apparatus for the 4 stroke-cycle internal combustion engine, the continuous variation of lift of intake valve is achieved by controlling an intake valve with controlling movement of a rocker arm, an intermediate lever and an eccentric cam shaft independent from the intake cam shaft. Such conventional valve train apparatus is described in, for example, the Germany magazine MOTOR-TECHNISCHE ZEITSCHRI FT (herein "MTZ"), Vieweg Verlag/GWV Fachverlage GmbH, 11/2004, pages 868, 876 and 878, and the Germany public magazine BMW Aftersales (herein "BMW"), BMW Corporation, Nr. 75, page 18.

According to the conventional invention described in the above-noted magazines, the continuous variation of the lift of intake valve is achieved by controlling an intake valve with controlling movement of a rocker arm, an intermediate lever and an eccentric cam shaft independent from the intake cam shaft. The intake cam shaft, the exhaust cam shaft and the eccentric cam shaft are supported at heights different from each other and secured via parting surfaces of different directions and screws. The parting surface of the exhaust cam shaft is formed by an upper surface parallel to a bottom surface of cylinder head, the parting surface of the intake cam shaft is formed by a surface at intake port side normal to the bottom surface of cylinder head, the parting surface of the eccentric cam shaft is formed by a surface at exhaust port side normal to the bottom surface of cylinder head, and a head cover mounting surface includes a parting surface of the exhaust cam shaft parallel to the bottom surface of cylinder head, upper surfaces of different heights and four machined surfaces of three different directions and secured by screws. Similarly each bearing cap is also formed by three separate parts and fastened by screws from three different directions. In addition, since the eccentric cam shaft is arranged at a highest position, a motor for controlling the eccentric cam shaft must be positioned at a very high position.

As shown in the magazine MTZ, the intermediate lever of the conventional invention is a straight rod shaped configuration and has a roller contacting an eccentric shaft of the intermediate lever, a sliding portion contacting a roller of intake rocker arm of the intermediate lever, and a roller contacting a intake cam shaft of the intermediate lever which are all arranged on a straight line. In addition, the roller contacting the eccentric cam shaft and the sliding portion contacting the roller of the intake rocker arm are arranged vertically opposite with respect to the central roller contacting the intake cam shaft.

In the valve train apparatus for the 4 stroke-cycle internal combustion engine of the conventional invention, there are problems of an increase of an overall height of a cylinder head, increase of machining surfaces for supporting the intake cam shaft, exhaust cam shaft and eccentric cam shaft, increase of machining directions of fastening screws, difficulties and complication of assembly, and substantial increase of manufacturing costs due to an increase of the number of structural parts. In addition, since the intermediate lever is made as a straight rod shaped member having heavy weight and low rigidity, it is difficult to reduce its length. This also causes the increase of the overall height of the cylinder head.

SUMMARY OF THE INVENTION

It is, therefore, an object of the present invention to provide a valve train apparatus for 4 stroke-cycle internal combustion engine which can achieve reduction of the overall height of the cylinder head, reduction of surfaces to be machined for supporting the intake cam shaft, exhaust cam shaft and eccentric cam shaft, reduction of the number of machining directions of fastening screws, and reduction of manufacturing costs by simplifying assembling steps as well as reducing the number of parts.

According to one aspect of the present invention, there is provided a valve train apparatus of 4 stroke-cycle internal combustion engine including an intake cam shaft and an exhaust cam shaft in which a lift of an intake valve is continuously varied by controlling rotations of the intake cam shaft and an eccentric cam shaft via an intermediate lever contacting the intake cam shaft and the eccentric cam shaft as well as via a rocker arm contacting the intermediate lever. At least two of a parting surface of a bearing of the eccentric cam shaft, a parting surface of a bearing of the intake cam shaft and a parting surface of a bearing of the exhaust cam shaft are arranged on a coplanar surface.

According to another aspect of the present invention, there is provided a valve train apparatus of 4 stroke-cycle internal combustion engine. At least two of the bearing of the eccentric cam shaft, the bearing of the intake cam shaft and the bearing of the exhaust cam shaft are formed as a unitary part.

According to yet another aspect of the present invention, there is provided a valve train apparatus of 4 stroke-cycle internal combustion engine including an intake cam shaft and an exhaust cam shaft in which a lift of an intake valve is continuously varied by controlling rotations of the intake cam shaft and an eccentric cam shaft via an intermediate lever contacting the intake cam shaft and the eccentric cam shaft as well as via a rocker arm contacting the intermediate lever. Axes respective of the intake cam shaft, the exhaust cam shaft and the eccentric cam shaft are arranged on a coplanar surface.

According to yet another aspect of the present invention, there is provided a valve train apparatus of 4 stroke-cycle internal combustion engine including an intake cam shaft and an exhaust cam shaft in which a lift of an intake valve is continuously varied by controlling rotations of the intake cam shaft and an eccentric cam shaft via an intermediate lever contacting the intake cam shaft and the eccentric cam shaft as well as via a rocker arm contacting the intermediate lever. The intermediate lever is a substantially triangular configuration and has a roller contacting the eccentric cam shaft arranged on the apex of triangle, a roller contacting the intake cam shaft arranged on the hypotenuse of triangle and a sliding portion contacting the rocker arm to cause swing motion thereof arranged on the base of triangle, and that at least two of a parting surface of a bearing of the eccentric cam shaft, a parting surface of a bearing of the intake cam shaft respectively contacting the rollers of the intermediate lever, and a parting surface of a bearing of the exhaust cam shaft are arranged on a coplanar surface.

According to yet another aspect of the present invention, there is provided a valve train apparatus of 4 stroke-cycle internal combustion engine. At least two of the bearing of the eccentric cam shaft, the bearing of the intake cam shaft and the bearing of the exhaust cam shaft are formed as a unitary part.

According to yet another aspect of the present invention, there is provided a valve train apparatus of 4 stroke-cycle internal combustion engine including an intake cam shaft and an exhaust cam shaft in which a lift of an intake valve is continuously varied by controlling rotations of the intake cam shaft and an eccentric cam shaft via an intermediate lever contacting the intake cam shaft and the eccentric cam shaft as well as via a rocker arm contacting the intermediate lever. The intermediate lever is a substantially triangular configuration and has a roller contacting the eccentric cam shaft arranged on the apex of triangle, a roller contacting the intake cam shaft arranged on the hypotenuse of triangle and a sliding portion contacting the rocker arm to cause swing motion thereof arranged on the base of triangle, and that axes of the eccentric cam shaft and the intake cam shaft respectively contacting the rollers of the intermediate lever and the axis of the exhaust cam shaft are arranged on a coplanar surface.

According to the one aspect of the present invention, since at least two of a parting surface of a bearing of the eccentric cam shaft, a parting surface of a bearing of the intake cam shaft and a parting surface of a bearing of the exhaust cam shaft are arranged on a coplanar surface, it is possible to achieve reduction of the overall height of the cylinder head, reduction of surfaces to be machined for supporting the intake cam shaft, exhaust cam shaft and eccentric cam shaft, reduction of the number of machining directions of fastening screws, and reduction of manufacturing costs by simplifying assembling steps as well as reducing the number of parts.

According to the another aspect of the present invention, since at least two of the bearing of the eccentric cam shaft, the bearing of the intake cam shaft and the bearing of the exhaust cam shaft are formed as a unitary part, it is possible to reduce manufacturing costs by reducing the number of parts.

According to the yet another aspect of the present invention, the axes respectively of the intake cam shaft, the exhaust cam shaft and the eccentric cam shaft are arranged on a coplanar surface, it is possible to achieve reduction of the overall height of the cylinder head, reduction of surfaces to be machined for supporting the intake cam shaft, exhaust cam shaft and eccentric cam shaft, reduction of the number of machining directions of fastening screws, and reduction of manufacturing costs by simplifying assembling steps as well as reducing the number of parts.

According to the yet another aspect of the present invention, the intermediate lever is a substantially triangular configuration and has a roller contacting the eccentric cam shaft arranged on the apex of triangle, a roller contacting the intake cam shaft arranged on the hypotenuse of triangle and a sliding portion contacting the rocker arm to cause swing motion thereof arranged on the base of triangle. Further, at least two of a parting surface of a bearing of the eccentric cam shaft, a parting surface of a bearing of the intake cam shaft respectively contacting the rollers of the intermediate lever, and a parting surface of a bearing of the exhaust cam shaft are arranged on a coplanar surface. Therefore, it is possible to achieve reduction of the overall height of the cylinder head, reduction of surfaces to be machined for supporting the intake cam shaft, exhaust cam shaft and eccentric cam shaft, reduction of the number of machining directions of fastening screws, and reduction of manufacturing costs by simplifying assembling steps. It is also possible to reduce the number of parts as well as to achieve improvement of weight reduction and increase of rigidity of the intermediate lever and thus increase of power and torque of the internal combustion engine and improvement of fuel consumption.

According to the yet another aspect of the present invention, since at least two of the bearing of the eccentric cam shaft, the bearing of the intake cam shaft and the bearing of the exhaust cam shaft are formed as a unitary part, it is possible to reduce manufacturing costs by reducing the number of parts.

According to the yet another aspect of the present invention, the intermediate lever is a substantially triangular configuration and has a roller contacting the eccentric cam shaft arranged on the apex of triangle, a roller contacting the intake cam shaft arranged on the hypotenuse of triangle and a sliding portion contacting the rocker arm to cause swing motion thereof arranged on the base of triangle. Further, axes of the eccentric cam shaft and the intake cam shaft respectively contacting the rollers of the intermediate lever and the axis of the exhaust cam shaft are arranged on a coplanar surface. Therefore, it is possible to achieve reduction of the overall height of the cylinder head, reduction of surfaces to be machined for supporting the intake cam shaft, exhaust cam shaft and eccentric cam shaft, reduction of the number of machining directions of fastening screws, and reduction of manufacturing costs by simplifying assembling steps. It is also possible to reduce the number of parts as well as to achieve improvement of weight reduction and increase of rigidity of the intermediate lever and thus increase of power and torque of the internal combustion engine and improvement of fuel consumption.

BRIEF DESCRIPTION OF THE DRAWINGS

Additional advantages and features of the present invention will become apparent from the subsequent description and the appended claims, taken in conjunction with the accompanying drawings, wherein:

DESCRIPTION OF THE PREFERRED EMBODIMENTS

Preferred embodiments of the present invention will be described with reference to accompanying drawings.

Figure 1:
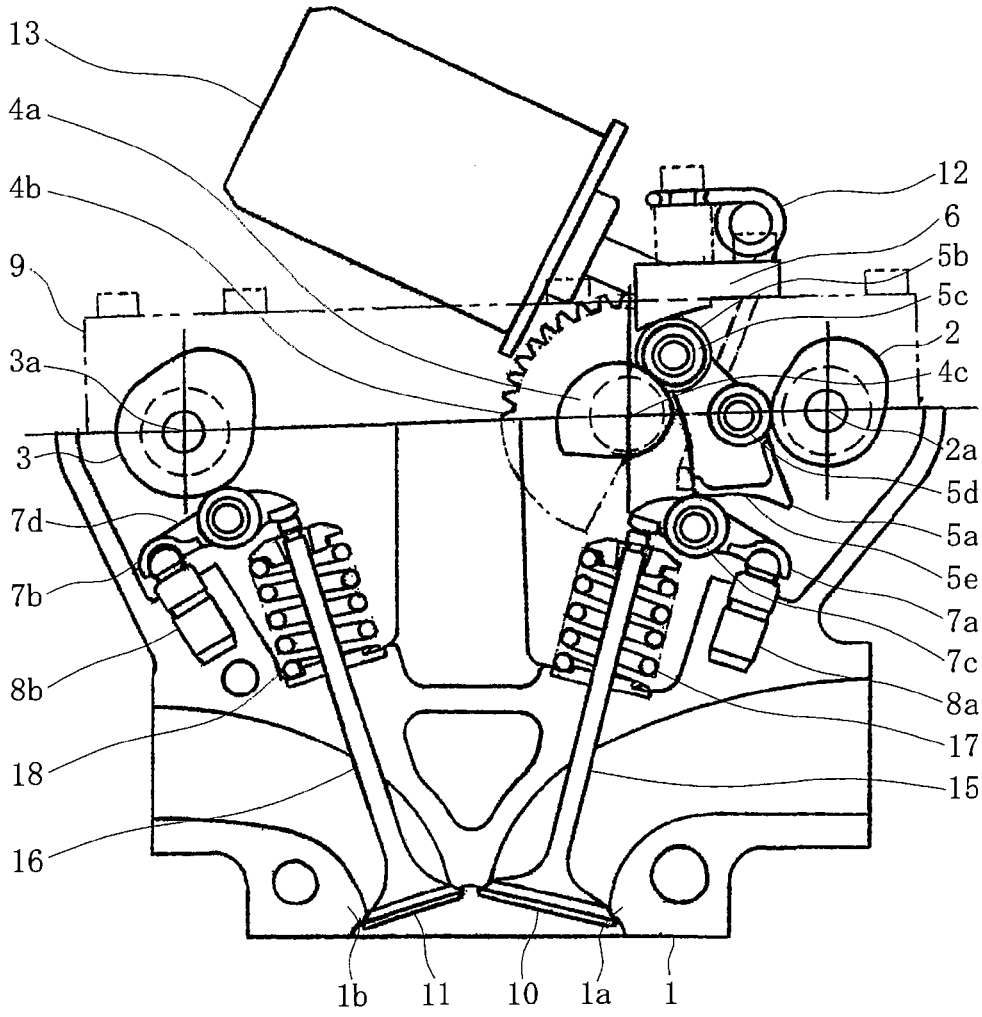
FIG. 1 is an explanatory cross-sectional view showing a valve train apparatus for 4 stroke-cycle internal combustion engine of one preferred embodiment of the present invention.
Figure 2:
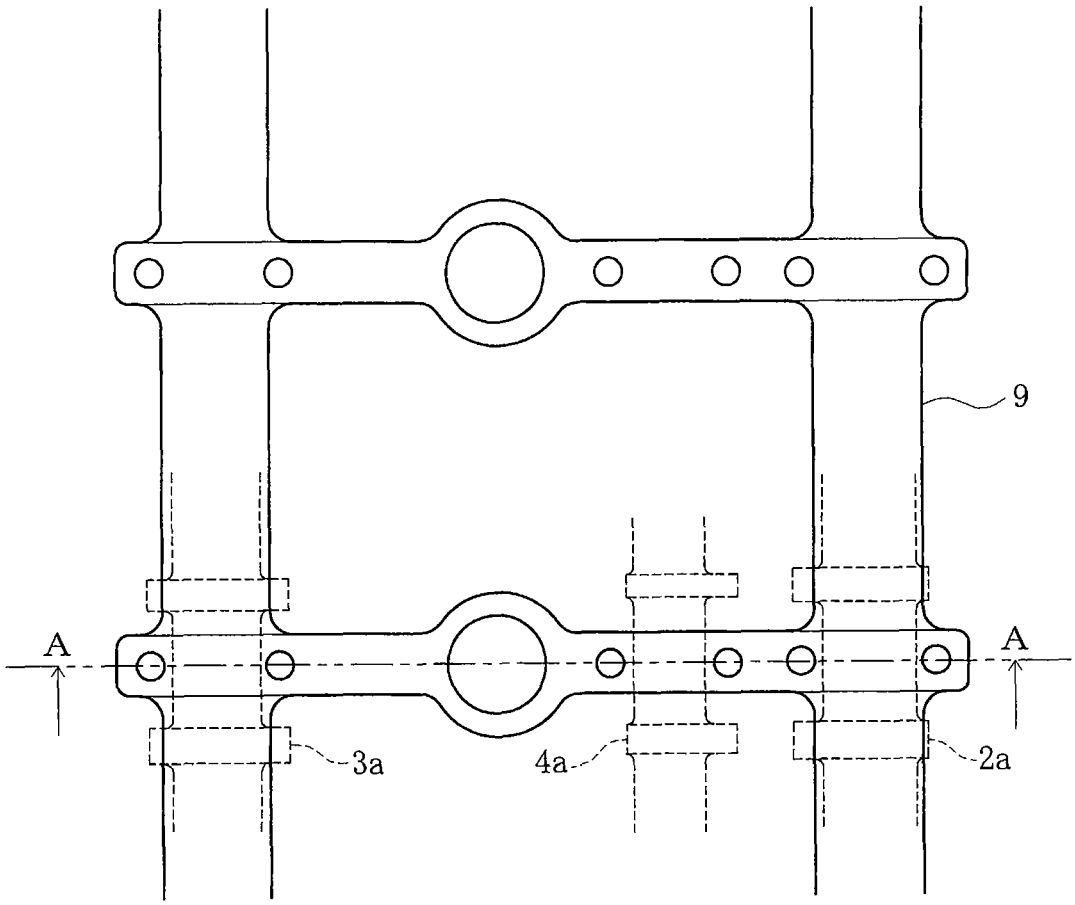
FIG. 2 is an explanatory plan view showing a unitary structure of bearing of intake cam shaft, exhaust cam shaft and eccentric cam shaft used in the valve train apparatus for 4 stroke-cycle internal combustion engine of the present invention.
Figure 3:
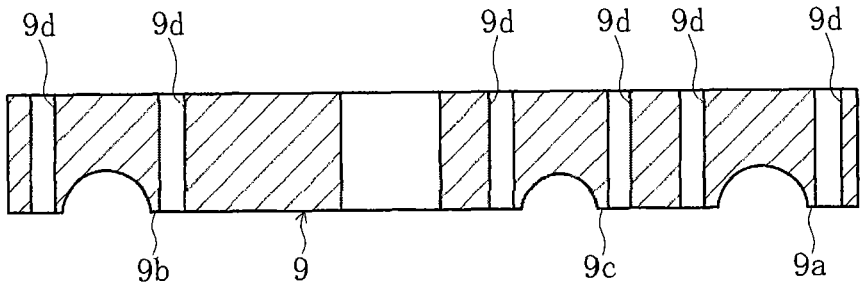
FIG. 3 is an explanatory cross-sectional view taken along a line A-A in FIG. 2.

Referring to the non-limiting embodiment shown in FIGS. 1-3, a cylinder head 1 of the 4 stroke-cycle internal combustion engine of the present invention includes a valve train apparatus including an intake cam shaft 2, an exhaust cam shaft 3, an eccentric cam shaft 4*a*, an intermediate lever 5*a*, an intake valve stem 15, an exhaust valve stem 16. A rotational axes 2*a*, 3*a* and 4*c* of the intake cam shaft 2, the exhaust cam shaft 3 and the eccentric cam shaft 4*a*, respectively, are arranged on the top surface of the cylinder head 1 so that they are positioned on a coplanar surface.

An eccentric cam shaft driving gear 4*b* is coaxially arranged on the eccentric cam shaft 4*a* and an electric motor 13 for driving the gear 4*b* is arranged above the eccentric cam shaft 4*a*. The lifting amount of the intake valve 10 are adapted to be continuously varied by rotating the eccentric cam shaft driving gear 4*b* by the electric motor 13 via a worm gear to control the eccentric cam shaft 4*a*.

The intermediate lever 5*a* is arranged between the eccentric cam shaft 4*a* and the intake cam shaft 2. The intermediate lever 5*a* is a substantially triangular configuration and has a roller that is an upper bearing with a smaller diameter 5*c* contacting the eccentric cam shaft 4*a* arranged on the apex of triangle, a roller that is an intermediate bearing 5*d* contacting the intake cam shaft 2 arranged on the hypotenuse of triangle, and a sliding portion 5*e* contacting a rocker arm 7*a* to cause swing motion thereof arranged on the base of triangle. The intermediate lever 5*a* can adjust the intake valve lift via a gate 6 guiding a larger diameter bearing 5*b*, the eccentric cam shaft 4*a* contacting the smaller diameter bearing 5*c*, the intake cam shaft 2 contacting the intermediate bearing 5*d*, and the rocker arm 7*a* contacting the sliding portion 5*e*. A force of a return spring 12 is applied to the bottom of the intermediate lever 5*a* so that the intermediate lever 5*a* is urged toward the intake cam shaft 2 to always contact therewith.

The intake rocker arm 7*a* is arranged below the intermediate lever 5*a*, the intake rocker arm 7*a* is swingable and is provided, on its middle portion, with a bearing 7*c* contacting the sliding portion 5*e* of the intermediate lever 5*a*. An end of an intake valve stem 15 of the intake valve 10 contacts one end of the rocker arm 7*a*. The other end of the rocker arm 7*a* contacts one end of a hydraulic tappet 8*a* of intake side for adjusting the motion of the rocker arm 7*a*. The intake valve stem 15 is urged upward (toward a direction closing an intake port 1*a*) by an intake valve spring 17 arranged between the cylinder head 1 and the intake rocker arm 7*a*.

On the other hand, an exhaust rocker arm 7*b* is arranged below the exhaust cam shaft 3. The rocker arm 7*b* is swingable and is provided, on its middle portion, with a bearing 7*d* contacting the exhaust cam shaft 3. An end of an exhaust valve stem 16 of the intake valve 11 contacts one end of the rocker arm 7*b*. The other end of the rocker arm 7*b* contacts one end of a hydraulic tappet 8*b* of exhaust side for adjusting the motion of the rocker arm 7*b*. The exhaust valve stem 16 is urged upward (toward a direction closing an exhaust port 1*b*) by an exhaust valve spring 18 arranged between the cylinder head 1 and the exhaust rocker arm 7*b*.

The intake cam shaft 2, the exhaust cam shaft 3 and the eccentric cam shaft 4*a* covered and thus supported by a unitary bearing 9 formed as a unitary part of the eccentric cam shaft bearing, intake cam shaft bearing and the exhaust cam shaft bearing. In the unitary bearing 9, three parting surfaces, which are a parting surface 9*c* of a bearing of the eccentric cam shaft 4*a*, a parting surface 9*a* of a bearing of the intake cam shaft 2 and a parting surface 9*b* of a bearing of the exhaust cam shaft 3, are arranged on a coplanar surface. In addition, as shown in FIG. 3, all directions (i.e., machining directions of apertures 9*d*) of the fastening screws of the unitary bearing 9 are substantially the same.

Further, the operation of the intake valve 10 of the valve train apparatus for 4 stroke-cycle internal combustion engine will be described. Starting from a condition in which the intake valve 10 closed the intake port 1*a* as shown in FIG. 1, the intake cam shaft 2 rotates toward a position of FIG. 4 in which the intermediate bearing 5*d* has shifted toward the eccentric cam shaft 4*a*.

Figure 4:
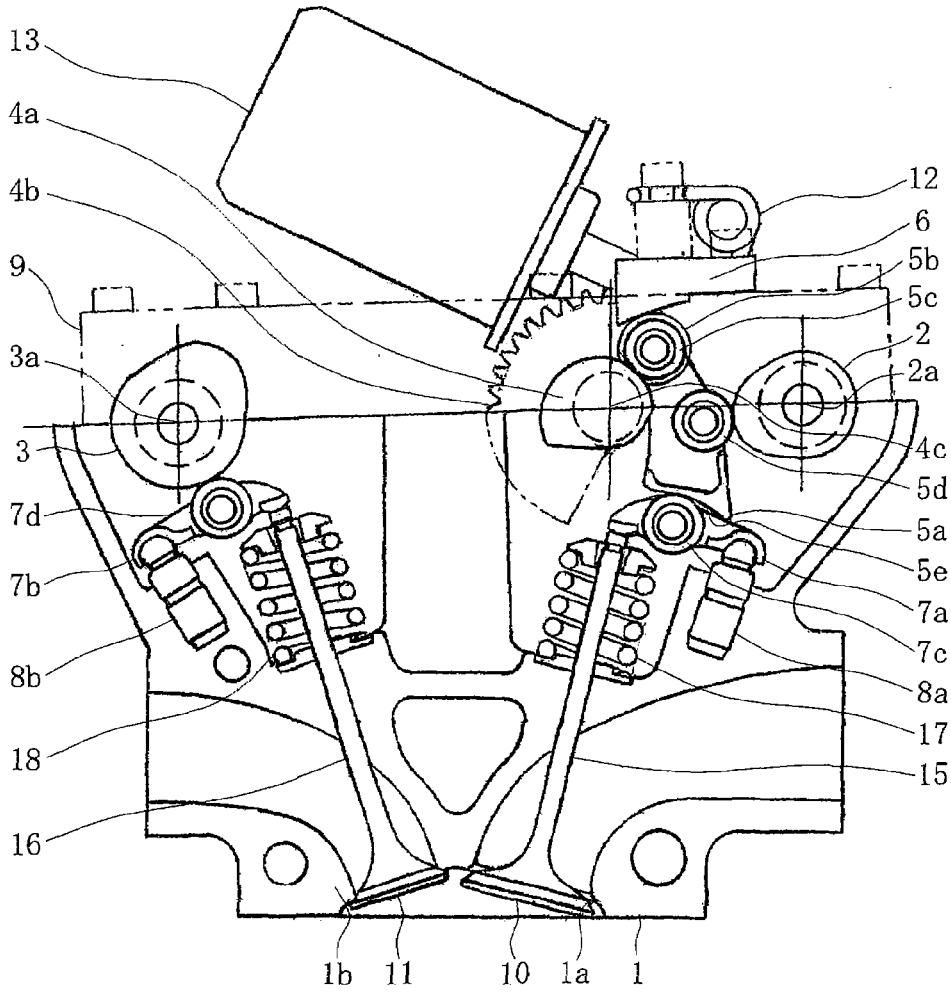
FIG. 4 is an explanatory cross-sectional view showing one operation of a valve train apparatus for 4 stroke-cycle internal combustion engine of FIG. 1.
Figure 5:
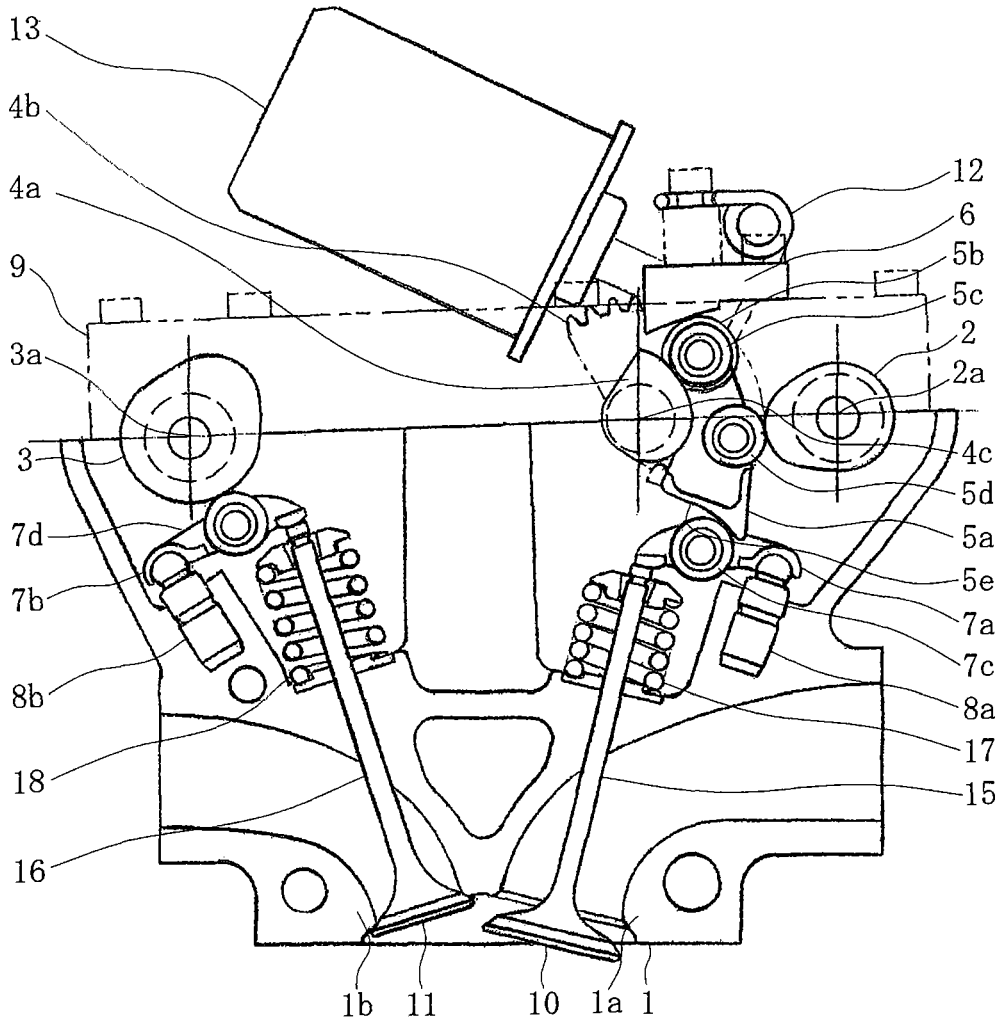
FIG. 5 is an explanatory cross-sectional view showing another operation of a valve train apparatus for 4 stroke-cycle internal combustion engine of FIG. 1.

In the position of FIG. 4, the intermediate lever 5*a* has shifted in the clockwise direction from the position of FIG. 1. Due to this shift of the intermediate lever 5*a*, the sliding portion 5*e* of the intermediate lever 5*a* is also shifted to the left in drawings. Thus, the intake rocker arm 7*a* is swung downward around the tappet 8*a*. Such a swing motion of the rocker arm 7*a* causes a downward movement of the intake valve stem 15 and thus the intake valve 10 against urging force of the valve spring 17. Then if the eccentric cam shaft 4*a* is rotated toward a position shown in FIG. 5, the intermediate lever 5*a* is furthermore swung. Thus, the downward motion of the intake valve 10 is increased. Accordingly the amount of intake valve lift can be varied continuously.

As can be seen above, according to the preferred embodiment of the present invention, it is possible to achieve reduction of the overall height of the cylinder head 1, reduction of surfaces to be machined for supporting the intake cam shaft 2, exhaust cam shaft 3 and eccentric cam shaft 4*a*, reduction of the number of machining directions of fastening screws, and reduction of manufacturing costs by simplifying assembling steps as well as reducing the number of parts. In addition, it is possible, in the unitary bearing 9, to improve the rigidity of the bearing and to reduce manufacturing costs by reducing the number of parts. Furthermore it is possible to improve the rigidity of the unitary bearing by the fastening force of the return spring 12 applied to the gate 6 and the unitary bearing 9 and to reduce the manufacturing costs by reducing the number of parts.

In addition, the intermediate lever 5*a* is a substantially triangular configuration and has the roller that is the bearing 5*c* of smaller diameter contacting the eccentric cam shaft 4*a* arranged on the apex of triangle, the roller that is the intermediate bearing 5*d* contacting the intake cam shaft 2 arranged on the hypotenuse of triangle, and the sliding portion 5*e* contacting the rocker arm 7*a* to cause swing motion thereof arranged on the base of triangle. Therefore, it is possible to reduce the length of the intermediate lever 5*a*, to arrange all of the parting surface 9*c* of the bearing of the eccentric cam shaft 4*a*, the parting surface 9*a* of the bearing of the intake cam shaft and the parting surface 9*b* of the bearing of the exhaust cam shaft 3 on a coplanar surface, to arrange all of the rotational axis 2*a* of the intake cam shaft, the rotational axis 3*a* of the exhaust cam shaft and the rotational axis 4*c* of the eccentric cam shaft on a coplanar surface, and to reduce the overall height of the cylinder head 1. In addition, according to such a structure of the intermediate lever 5*a*, it is possible to reduce the weight of the intermediate lever 5*a* and to improve the rigidity thereof and thus to increase of power and torque of the internal combustion engine and improvement of fuel consumption.

Figure 6:
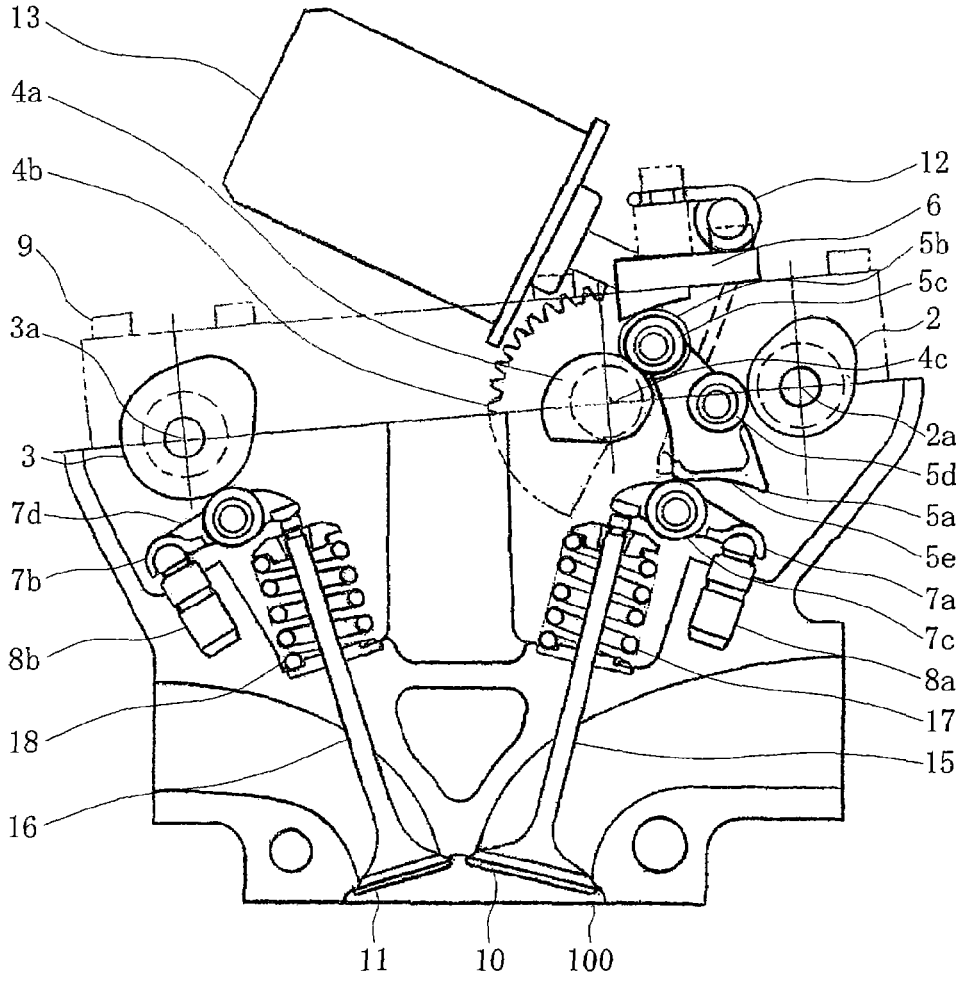
FIG. 6 is an explanatory cross-sectional view showing a valve train apparatus for 4 stroke-cycle internal combustion engine of another preferred embodiment of the present invention.

In the preferred embodiment described above, all of the rotational axis 2*a* of the intake cam shaft, the rotational axis 3*a* of the exhaust cam shaft and the rotational axis 4*c* of the eccentric cam shaft are arranged on a coplanar surface that is arranged as a horizontal surface relative to the cylinder head 1. However, it is unnecessary to arrange the coplanar surface as a horizontal surface and thus possible to incline it relative to the cylinder head 100 as shown in FIG. 6. Furthermore, the coplanar surface, on which all of the parting surface 9*c* of the bearing of the eccentric cam shaft 4*a*, the parting surface 9*a* of the bearing of the intake cam shaft and the parting surface 9*b* of the bearing of the exhaust cam shaft 3 are arranged, may be inclined. Although it is inclined, it is possible to reduce the surfaces to be machined for supporting the intake cam shaft, exhaust cam shaft and eccentric cam shaft, the number of machining directions of fastening screws, and the manufacturing costs by simplifying assembling steps as well as reducing the number of parts.

Figure 7:
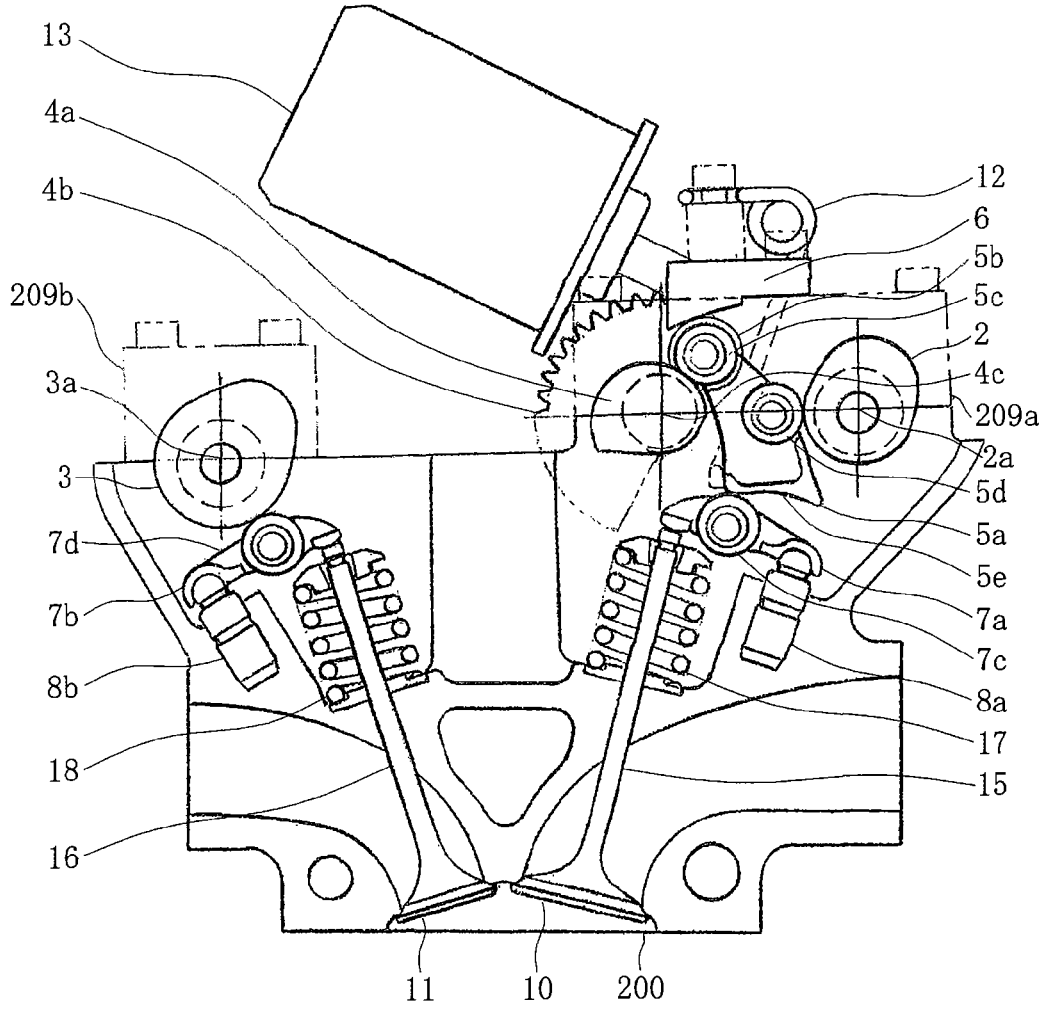
FIG. 7 is an explanatory cross-sectional view showing a valve train apparatus for 4 stroke-cycle internal combustion engine of further preferred embodiment of the present invention.

In the preferred embodiment described above, all of the parting surface 9*c* of the bearing of the eccentric cam shaft 4*a*, the parting surface 9*a* of the bearing of the intake cam shaft 2 and the parting surface 9*b* of the bearing of the exhaust cam shaft 3 are arranged on the coplanar surface as shown in FIG. 3. However it is unnecessary to arrange these three parting surfaces 9*a*, 9*b* and 9*c* on a coplanar surface. For example, as shown in FIG. 7, it is possible to arrange the parting surface of the bearing of the eccentric cam shaft 4*a* and the parting surface of the bearing of the intake cam shaft 2 on a coplanar surface and to arrange the parting surface of the bearing of the exhaust cam shaft 3 on another surface. In such a case the parting surface of the bearing of the eccentric cam shaft 4*a* and the parting surface of the bearing of the intake cam shaft 2 are formed by a unitary bearing 209*a* and the parting surface of the bearing of the exhaust cam shaft 3 is formed by another bearing 209*b*. It will be understood that effects of reduction of surfaces to be machined, reduction of the number of machining directions of fastening screws, and reduction of manufacturing costs by simplifying assembling steps as well as reducing the number of parts can be also achieved by arranging two parting surfaces, which are the parting surface of the bearing of the eccentric cam shaft and the parting surface of the bearing of the intake cam shaft, on a coplanar surface. In addition it is also possible to reduce the manufacturing costs by simplifying assembling steps as well as reducing the number of parts, for example, by providing the unitary bearing 209*a* for the bearing of the eccentric cam shaft and the bearing of the intake cam shaft.

As described above, according to the present invention, it is possible to provide a valve train apparatus for 4 stroke-cycle internal combustion engine which can achieve reduction of the overall height of cylinder head, reduction of surfaces to be machined for supporting the intake cam shaft, exhaust cam shaft and eccentric cam shaft, reduction of the number of machining directions of fastening screws, and reduction of manufacturing costs by simplifying assembling steps as well as reducing the number of parts.

The present invention has been described with reference to the preferred embodiment. Obviously, modifications and alternations will occur to those of ordinary skill in the art upon reading and understanding the preceding detailed description. It is intended that the present invention be construed as including all such alternations and modifications insofar as they come within the scope of the appended claims or the equivalents thereof.

What is claimed is:

1. A valve train apparatus of 4 stroke-cycle internal combustion engine, comprising:

an intake cam shaft;

an exhaust cam shaft;

an eccentric cam shaft;

an intermediate lever;

a rocker arm; and an intake valve, a lift of the intake valve configured to be continuously varied by controlling rotations of the intake cam shaft and the eccentric cam shaft via the intermediate lever contacting the intake cam shaft and the eccentric cam shaft and via the rocker arm contacting the intermediate lever, wherein a parting surface of a bearing of the eccentric cam shaft, a parting surface of a bearing of the intake cam shaft and a parting surface of a bearing of the exhaust cam shaft are arranged on a coplanar surface.

2. The valve train apparatus of 4 stroke-cycle internal combustion engine according to claim 1, wherein the bearing of the eccentric cam shaft, the bearing of the intake cam shaft and the bearing of the exhaust cam shaft are formed as a unitary part.

3. A valve train apparatus of 4 stroke-cycle internal combustion engine, comprising:

an intake cam shaft;

an exhaust cam shaft;

an eccentric cam shaft;

an intermediate lever;

a rocker arm; and an intake valve, a lift of the intake valve configured to be continuously varied by controlling rotations of the intake cam shaft and the eccentric cam shaft via the intermediate lever contacting the intake cam shaft and the eccentric cam shaft and via the rocker arm contacting the intermediate lever, wherein axes of the intake cam shaft, the exhaust cam shaft and the eccentric cam shaft, respectively, are arranged on a coplanar surface.

4. A valve train apparatus of 4 stroke-cycle internal combustion engine, comprising:

an intake cam shaft;

an exhaust cam shaft;

an eccentric cam shaft;

an intermediate lever;

a rocker arm; and an intake valve, a lift of the intake valve configured to be continuously varied by controlling rotations of the intake cam shaft and the eccentric cam shaft via the intermediate lever contacting the intake cam shaft and the eccentric cam shaft and via the rocker arm contacting the intermediate lever, wherein the intermediate lever is a substantially triangular shape, and has a roller contacting the eccentric cam shaft arranged on an apex of the triangular shape, another roller contacting the intake cam shaft arranged on a hypotenuse of the triangular shape, and a sliding portion contacting the rocker arm to cause swing motion thereof arranged on a base of the triangular shape, and a parting surface of a bearing of the eccentric cam shaft, which contacts the roller of the intermediate lever, a parting surface of a bearing of the intake cam shaft, which contacts the another roller of the intermediate lever, and a parting surface of a bearing of the exhaust cam shaft are arranged on a coplanar surface.

5. The valve train apparatus of 4 stroke-cycle internal combustion engine according to claim 4, wherein the bearing of the eccentric cam shaft, the bearing of the intake cam shaft and the bearing of the exhaust cam shaft are formed as a unitary part.

6. A valve train apparatus of 4 stroke-cycle internal combustion engine, comprising:

an intake cam shaft;

an exhaust cam shaft;

an eccentric cam shaft;

an intermediate lever;

a rocker arm; and an intake valve, a lift of the intake valve configured to be continuously varied by controlling rotations of the intake cam shaft and the eccentric cam shaft via the intermediate lever contacting the intake cam shaft and the eccentric cam shaft, and via the rocker arm contacting the intermediate lever, wherein the intermediate lever is a substantially triangular shape and has a roller contacting the eccentric cam shaft arranged on an apex of the triangular shape, another roller contacting the intake cam shaft arranged on a hypotenuse of triangular shape and a sliding portion contacting the rocker arm to cause swing motion thereof arranged on a base of triangular shape, and axes of the eccentric cam shaft and the intake cam shaft, which are contacting the rollers of the intermediate lever, respectively, and axis of the exhaust cam shaft are arranged on a coplanar surface.

* * * * *